US005725301A

United States Patent [19]

Jung

[11] Patent Number: 5,725,301

[45] Date of Patent: Mar. 10, 1998

[54] EARTHQUAKE DETECTION DEVICE

[76] Inventor: Michael Jung, 7716 Fair Ave., Sun Valley, Calif. 91352

[21] Appl. No.: 518,589

[22] Filed: Aug. 14, 1995

Related U.S. Application Data

[63] Continuation-in-part of Ser. No. 230,726, Apr. 21, 1994, abandoned.

[51] Int. Cl.[6] ..... F21V 25/00

[52] U.S. Cl. ..... 362/276; 362/205; 362/802; 200/61.45 R; 340/690

[58] Field of Search ..... 362/183, 205, 362/253, 276, 802; 200/61.45 R, 61.49; 340/690

[56] References Cited

U.S. PATENT DOCUMENTS

| | | | |
|---|---|---|---|
| 3,813,505 | 5/1974 | Shoji | 200/61.45 R |
| 4,357,648 | 11/1982 | Nelson | 362/183 |
| 4,408,196 | 10/1983 | Freeman | 200/61.45 R |
| 4,789,922 | 12/1988 | Cheshire | 362/158 |
| 4,841,288 | 6/1989 | Addicks | 340/690 |
| 5,365,145 | 11/1994 | Fields | 315/86 |
| 5,418,523 | 5/1995 | Anderson et al. | 200/61.45 R |

*Primary Examiner*—Stephen F. Husar
*Attorney, Agent, or Firm*—Eugene Oak

[57] ABSTRACT

An earthquake detection device with an innovative mechanism capable of sensing vibrations. The device is an open electrical circuit that, when triggered by sufficient vibration, becomes a closed circuit, thus enabling a variety of electrical appliances. The inner mechanism of the present invention works much like a conventional pulley. A weighted object, when agitated by sufficient vibration, causes a balance beam to fall out of a delicate equilibrium, thereby causing a hammer to fall on two receptacles which carry the electrical circuit, thus closing the circuit and enabling the electrical appliances.

2 Claims, 6 Drawing Sheets

EARTHQUAKE DETECTION DEVICE

CROSS-REFERENCE TO RELATED APPLICATION

This application is a continuation-in-part application of the previously filed application with Ser. No. 08/230,726, filed on Apr. 21, 1994, entitled "Earthquake Alert Flashlight Lighting Apparatus" now abandoned.

BACKGROUND OF THE INVENTION

1. Field of the Invention

The present invention generally relates to earthquake detection, specifically to a device which enables a siren and a warning light upon discerning subtle vibrations. The device may also be used in conjunction with a radio, a flashlight, or any other electric device which may be valuable in the event of an earthquake.

2. Description of the Prior Art

Prior art in the field of earthquake detection teach several variations in design and function. However, none of these resemble the present invention. U.S. Pat. No. 4,841,288 to Addicks discloses an Earthquake Illuminating Device. The device has "motion detection switch latches" which upon being closed, provide a high level signal that opens the control gate and completes the electrical circuit, thereby turning on the light bulb. This device differs from the present invention in that the "motion detection switch latches" of the device rely solely on the motion created by an earthquake to complete the circuit. There is no mechanical aid present in this invention to assist in the detection of an earthquake. The present invention, however, includes a mechanism which is sensitive to earthquakes, and, in the event of an earthquake, initiates the completion of the electrical circuit. In addition, the present invention has both a warning light and a siren, wherein the prior art discloses a device only with a light. Also, the present invention provides for another electrical appliance to be connected to this circuit, perhaps a radio or a flashlight.

U.S. Pat. No. 4,357,648 to Nelson discloses a flashlight with rechargeable batteries. The present invention does not claim a flashlight, nor does it claim a flashlight with rechargeable batteries.

U.S. Pat. No. 4,789,922 to Cheshire discloses an Earthquake Safety Light which includes a mechanism which, when enabled, closes an electric circuit, thereby turning on the light. The mechanism for this device is a weighted object which is displaced in the event of an earthquake. This weighted object is set on a pedestal-like base. In the event of an earthquake, the object falls off the base and descends into a "spring element", which, when depressed, closes the circuit, thereby turning on the light. Although both this device and the present invention rely on mechanisms to close an electrical circuit, the nature of the two mechanisms are completely different, as the Detailed Description explains.

U.S. Pat. No. 3,813,505 to Shoji discloses a Sensing Device of Acceleration and Vibration which utilizes magnetic force to detect vibration such as that which results from an earthquake. As a result, a cylindrical weight descends, which ultimately actuates "the valves or cocks, or electrical switches or air-operated microswitches". The present invention does not utilize magnetic forces, nor does it utilize a dropping weight to close an electrical circuit. Instead, the swaying motion of a weight in the event of an earthquake initiates a mechanism which in turn closes the electrical circuit.

Although several prior art disclose different mechanisms which detect vibrations and motion resulting from earthquakes, none of the prior art teach a mechanism similar to that disclosed by the present invention, aside from the common similarities that exist even among the patented mechanisms. Therefore these similarities, such as the utilization of weights, electronics, and open/closed circuitry, should not be held against the present invention, since these similarities even exist among the prior art.

Consequently, the principle object of the present invention is to provide an improved earthquake detecting device.

It is another object of the present invention to provide an earthquake detecting device which is relatively simple to activate and operate.

It is yet another object of the present invention to provide an earthquake detecting device which possesses both a warning light and a siren, and which also accommodates a third electrical appliance to be connected in the same circuit.

It is a further object of the present invention to provide an earthquake detecting device which is relatively inexpensive to manufacture.

SUMMARY OF THE INVENTION

The present invention is an earthquake detection device which comprises a detection mechanism which is capable of sensing vibrations, including those created by an earthquake. When the detection mechanism is set off, an open circuit is completed and an alarm and a warning light are enabled. Another electrical appliance can also be integrated into the previous circuit to allow additional safety in the event of an earthquake.

These together with other objects of the invention are pointed out clearly in the claims annexed to and forming part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 2:
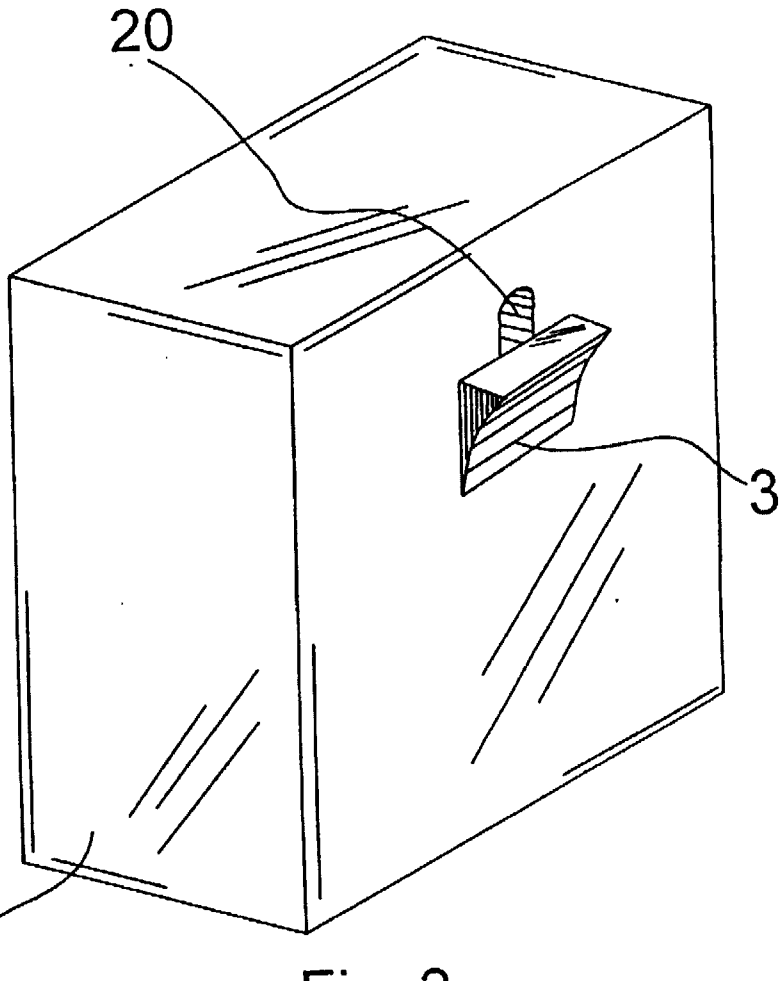
FIG. 2 is a perspective back view of the present invention.
Figure 1:
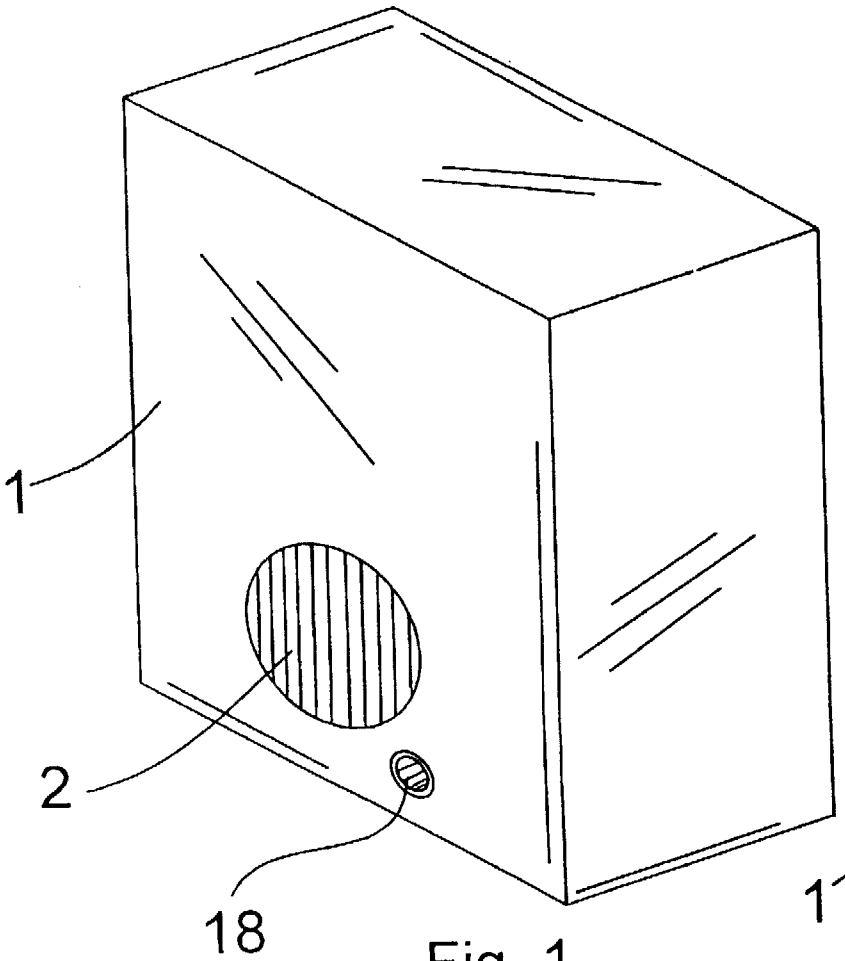
FIG. 1 is a perspective view of the present invention.

Referring to FIG. 1, the exterior of the Earthquake Detection Device is rather simple. A housing 1 encases the actual device. A vent 2 is provided so that the alarm located inside the housing 1 may be audible in the event of an earthquake. A socket 18 is provided in which an electrical appliance can be incorporated to work in conjunction with the device. FIG. 2 depicts the opposite side of the present invention as depicted in FIG. 1. Located on the opposite side is a handle 3. This handle 3 can be pulled upward, and is used to arm the device. After the handle 3 is pulled upward, it returns to its original position. To reset the device, the handle 3 is pulled upward again. The handle 3 is pulled along an elongated aperture 20, which runs vertically along the housing 1.

Figure 3:
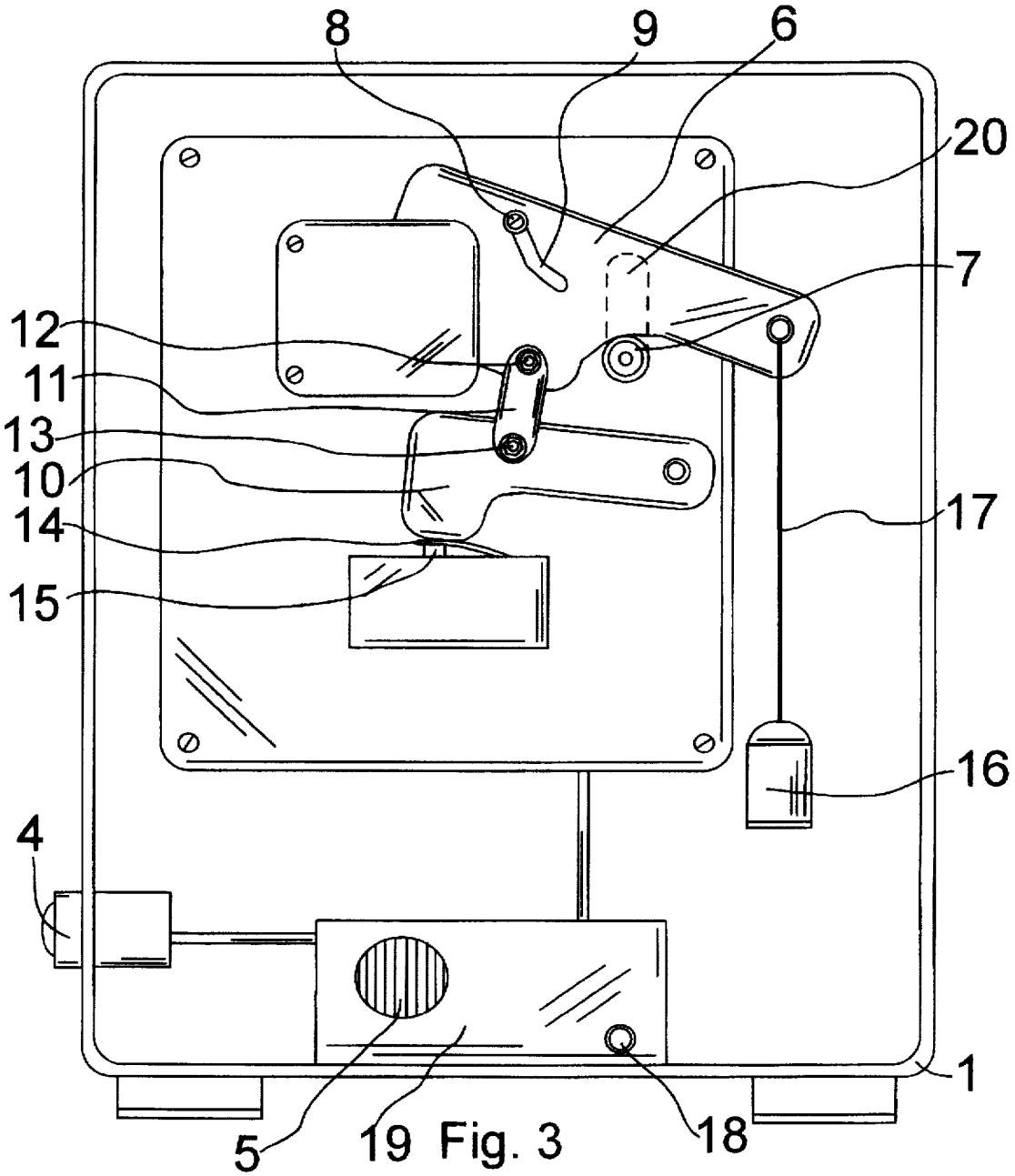
FIG. 3 is a frontal view of the present invention with the circuit being closed; this view exposes its inner parts.
Figure 4:
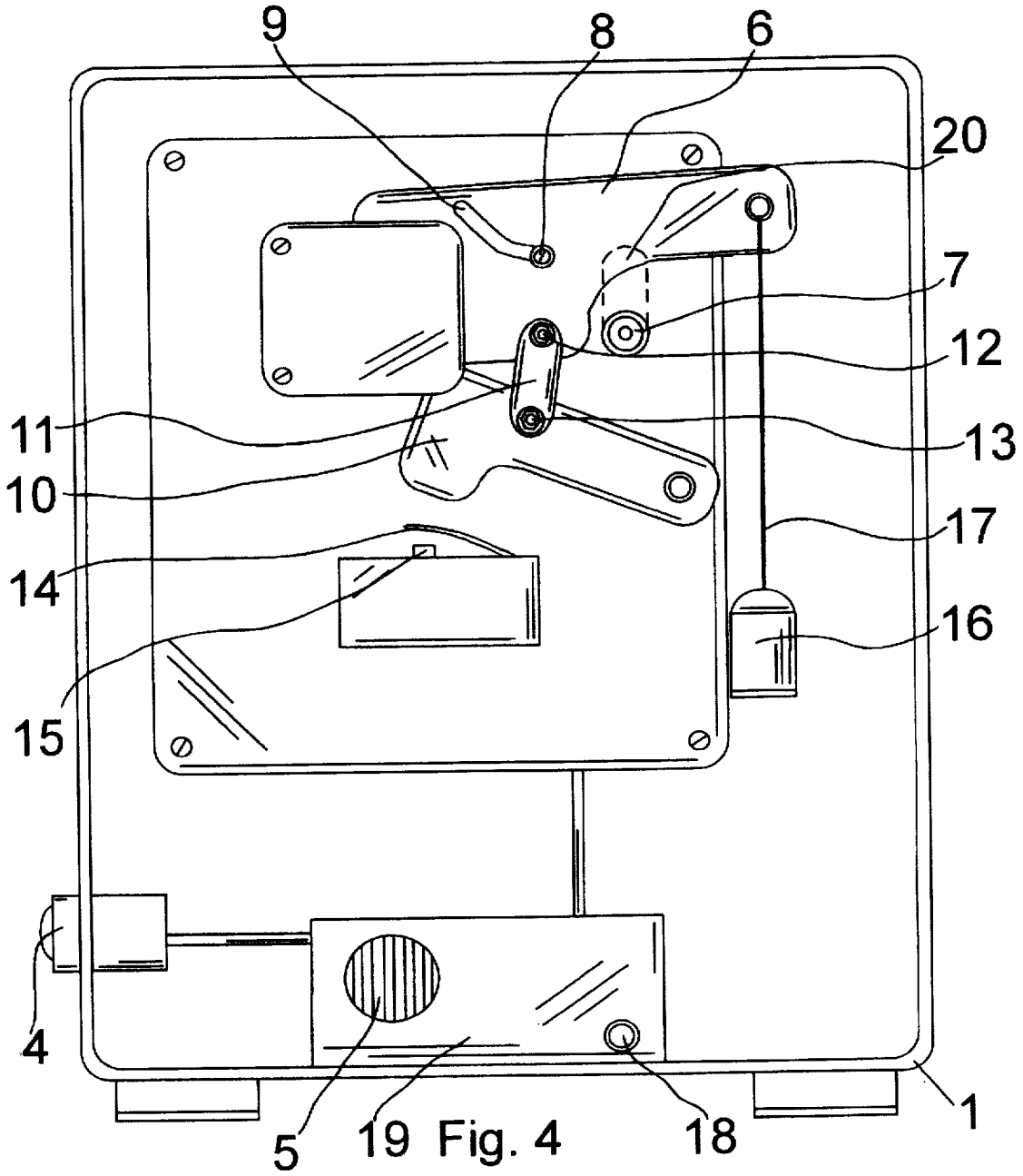
FIG. 4 is a frontal view of the present invention with the circuit being open; this view exposes its inner parts.

Referring to FIG. 3, the inner mechanism of the device is exposed. The device is an open circuit, which, when triggered by a substantial amount of vibration, becomes a closed circuit which induces the operation of a warning light 4 and a siren 5. FIG. 3 depicts the inner mechanism in a lower position, with the circuit being closed. FIG. 4 depicts the inner mechanism in an upper position, with the circuit being open and the device 'earthquake-ready'. The device is powered by a conventional battery 19. The inner mechanism works much like a conventional pulley. A balance beam 6 rests on a handle rod 7, which is connected to the handle 3. When the handle 3 is pulled upward as described above, the handle rod 7 also moves upward. Likewise, the balance beam 6 is also pulled upward. When the balance beam is pulled to the utmost position, a holding rod 8 slides into a curved aperture 9 which is a part of the balance beam 6. In this manner, the balance beam 6 is held in the upper position, due to the holding rod 8 being stationary in the curved aperture 9. This position is induced by the upward movement of the handle rod 7. The balance beam 6 is connected to a triggering hammer 10, by means of an intermediate connecting shaft 11. The intermediate connecting shaft 11 is rotatably connected to both the balance beam 6 and the triggering hammer 10 at the opposite ends of the shaft 11. The upper joint 12 of the intermediate connecting shaft 11 is rotatably connected to the balance beam. Likewise, the lower joint 13 of the intermediate connecting shaft 11 is rotatably connected to the triggering hammer 10. It is imperative that these joints 12 and 13 operate with the least amount of friction as possible. Moreover, the tangential connection between the handle rod 7 and the balance beam 6 must also have very little friction for the device to operate properly. The friction existing at these junctures determine the sensitivity of the mechanism.

The head of the triggering mechanism 10 is located directly above an upper receptacle 14 and a lower receptacle 15. These receptacles 14 and 15, when in contact with each other, close the electrical circuit, thus enabling the siren 5 and warning light 4. When the balance beam 6 is in the upper position, however, the upper receptacle 14 and the lower receptacle 15 are not in contact with each other because the triggering hammer is not pressing down on the upper receptacle 14. The opposite end of the triggering hammer 10 is rotatably connected to the housing 1.

Hanging on the opposite end of the balance beam 6 is a weighted object 16 which is suspended by a cord 17. This weighted object 16 dictates whether or not vibrations are sufficient enough to set off the device. In the event of an earthquake, the weighted object 16 begins to sway side to side, thus inducing the balance beam 6 to move slightly. This delicate movement of the balance beam 6 causes the curved aperture 9 to slide off the holding rod 8. Thus the whole balance beam 6 falls into a lower position, causing the intermediate connecting shaft 11 to press the triggering hammer 10 downward, which connects the upper receptacle 14 to the lower receptacle 15, thus closing the electrical circuit and enabling the siren 5 and the warning light 4.

The socket 18 is an input for any electrical appliance that is intended to work in conjunction with the device. An electrical appliance connected to the device becomes operative when the circuit is completed; thus the siren 5, the warning light 4, and the electrical appliance are all enabled simultaneously. Because the three appliances are wired in parallel circuits, the operation of any of the three appliances is not contingent upon the operation of the other two appliances. Thus the device works with or without an additional appliance connected through the socket 18. The type of socket 18 is not specified, since electrical adapters would make a specification irrelevant.

Figure 5:
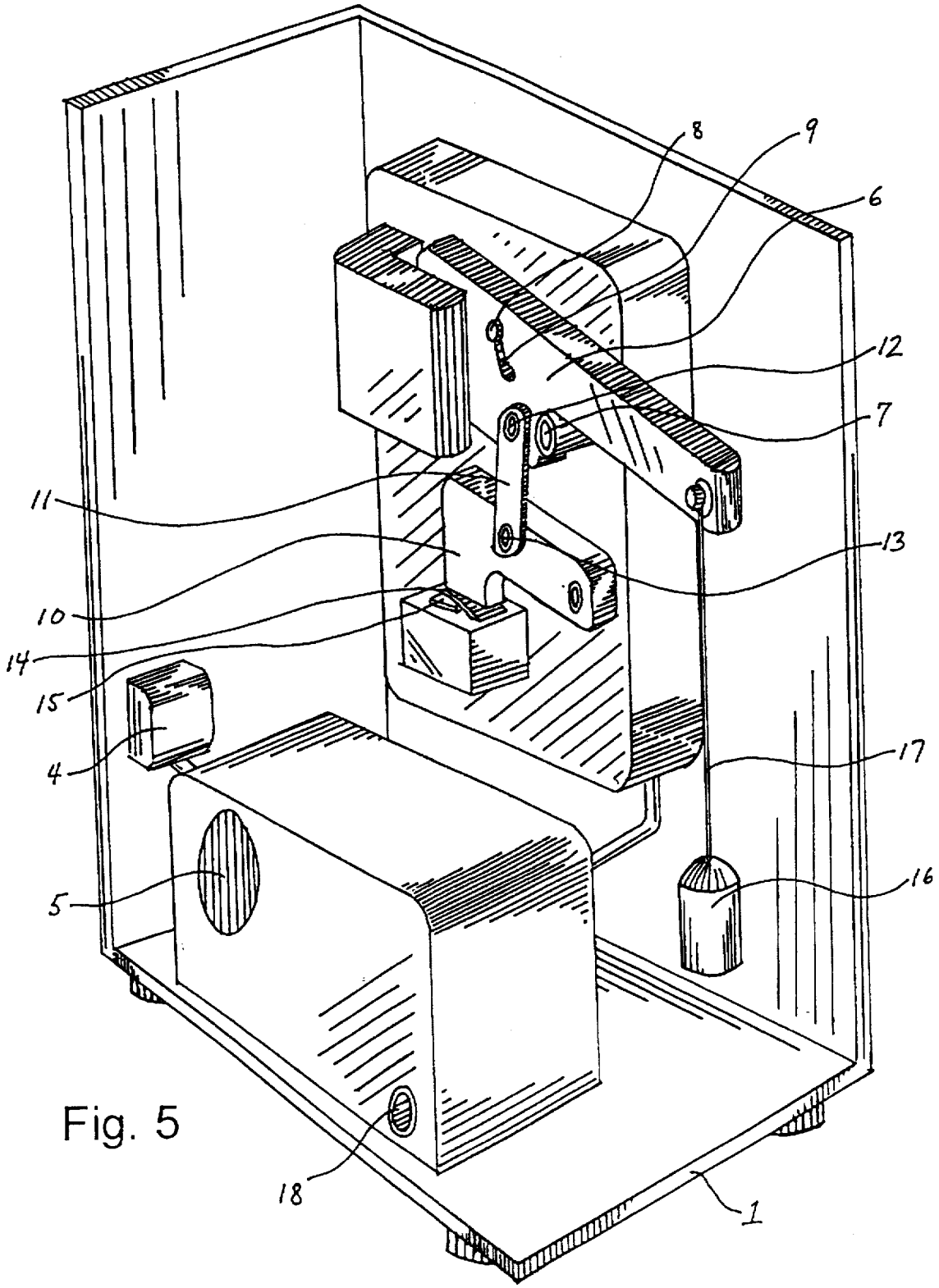
FIG. 5 is a perspective view of the present invention exposing its inner parts.
Figure 6:
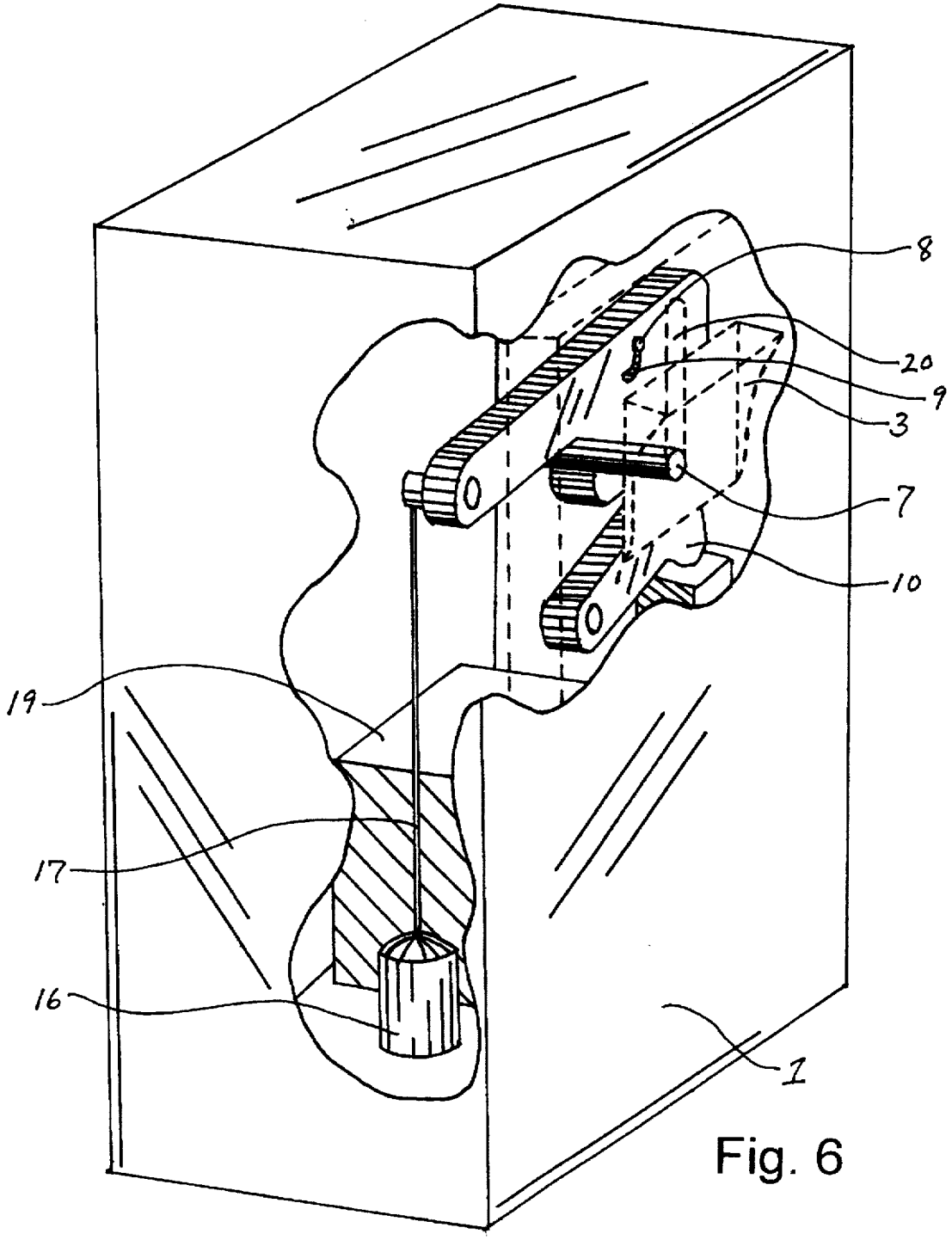
FIG. 6 is a perspective cutaway back view of the present invention exposing its inner parts.

FIG. 5 is a perspective view of the present invention exposing the inner mechanism. The device is depicted in its lower position, with the circuit being closed. FIG. 6 is a perspective back view of the present invention exposing the handle rod 7; the handle 3 and the elongated aperture 20 are shown in dotted lines.

Figure 7:
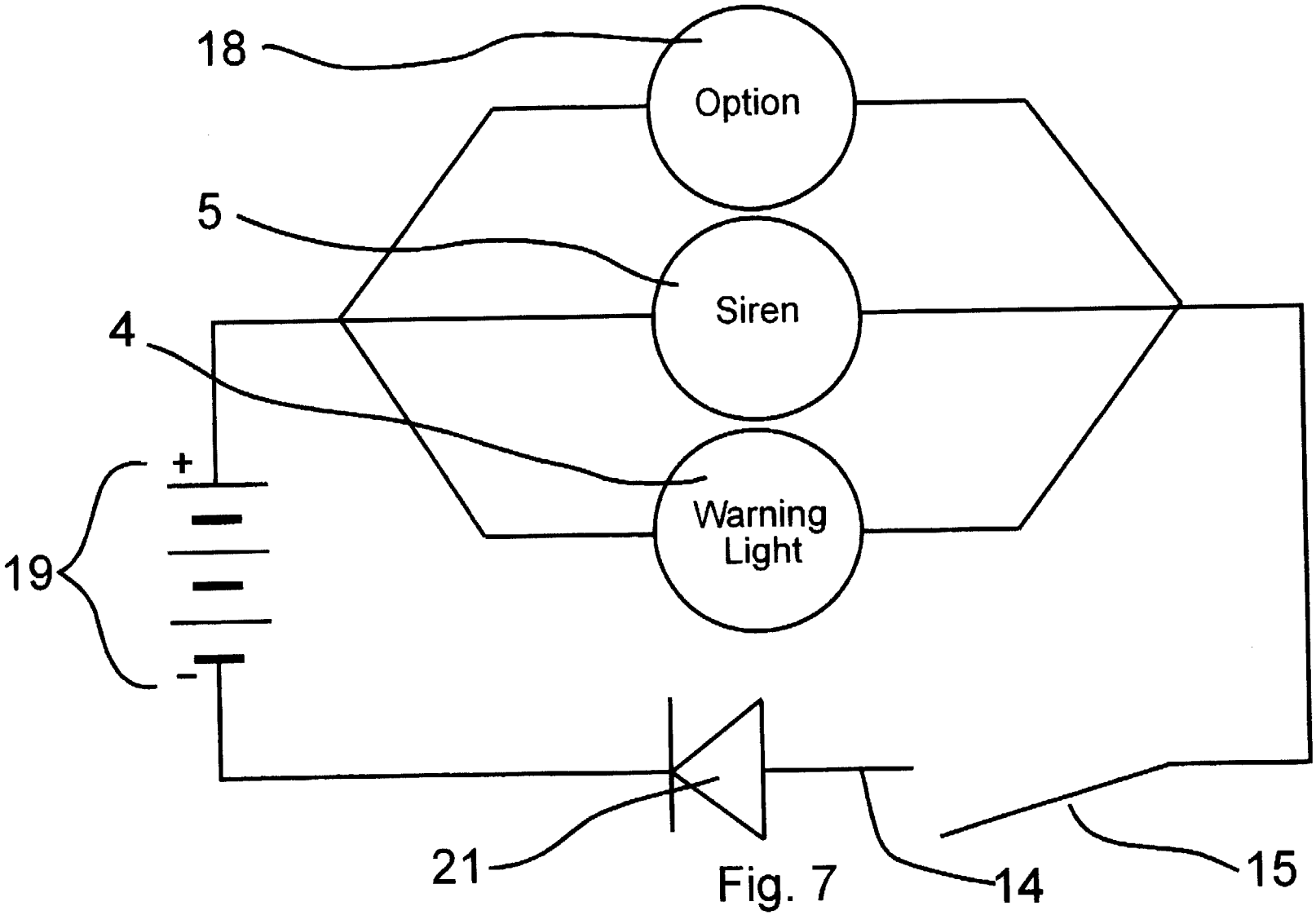
FIG. 7 is a schematic diagram of the electrical circuit of the present invention.

FIG. 7 is a schematic drawing of the circuit existing in the present invention. The warning light 4, the siren 5, and the optional electrical appliance 18 are connected in a parallel circuit. The receptacles 14 and 15 are represented in this diagram by a break in the circuit. There is a diode 21, which ensures that the current will flow in only one direction to prevent circuit damage.

What is claimed as being new and therefore desired to be protected by letter patent of the United States is as follows:

1. An earthquake detection device comprising:

a) a housing;

b) said housing encasing a siren, a warning light, a battery, and an inner mechanism;

c) said siren and said warning light existing in a parallel circuit, wherein said battery exists as a power source;

d) said circuit existing as an open circuit when a balance beam is in an upper position;

1) wherein break of said circuit exists at two receptacles positioned adjacently to but not in contact with each other; and e) said circuit existing as a closed circuit when said balance beam is in a lower position;

1) wherein said circuit may be closed by allowing said receptacles to come into contact with each other;

f) said inner mechanism comprising:

1) said balance beam, wherein said balance beam has a rectangular shape, a left and right side, a middle, and a curved aperture;

a) said balance beam resting on a handle rod, wherein said handle rod is situated under said middle of said balance beam;

b) said curved aperture existing on said left side of said balance beam and accommodating a holding rod, wherein said curved aperture having a left end and a right end;

c) said holding rod fixed to said housing, wherein said balance beam may be situated so that said holding rod is positioned at either of said ends of said curved aperture of said balance beam;

d) a weighted object attached to and suspending from a cord, wherein opposite end of said cord is attached to said right side of said balance beam; and e) said balance beam being positioned above and rotatably connected to an intermediate connecting shaft, wherein opposite end of said intermediate connecting shaft is rotatably connected to a triggering hammer, wherein said triggering hammer is positioned below said intermediate connecting shaft;

2) said triggering hammer having a left and right side;

a) wherein said triggering hammer is rotatably connected to said housing at said right side of said triggering hammer; and b) said triggering hammer being situated directly above and in contact with one of said receptacles, wherein said other receptacle is positioned directly below and in contact with previously mentioned receptacle;

3) said handle rod extending through an elongated aperture in said housing, and connecting to a handle which is situated outside of said housing;

a) said elongated aperture being vertically elongated and accommodating up and down movement of said handle rod initiated by pulling up said handle;

b) said balance beam being pulled upward as handle is being pulled, because said handle rod is also pulled upward;

c) wherein said left side of said balance beam descends and said right side of said balance beam ascends as said balance beam is pulled upward, due to said intermediate connecting shaft being rotatably connected to left side of said balance beam and said triggering hammer, and said triggering hammer being rotatably affixed to said housing;

d) wherein when said handle is pulled to an utmost position relative to said elongated aperture, said balance beam slides along said curved aperture until said right end of said curved aperture comes into contact with said holding bar, thereby stabilizing said balance beam in an upper position;

e) wherein said handle and said handle bar return to bottom of said elongated aperture when released, but said balance beam remains in said upper position due to said holding bar being located at said right end of said curved aperture;

f) wherein said receptacles, no longer under pressure from said triggering hammer, are separated, thus opening said circuit;

g) wherein when said weighted object sways and vibrates, vibrations cause said curved aperture to slide off said holding bar until said left end of said curved aperture comes in contact with said holding bar, thus displacing said balance beam to lower position, thereby causing said triggering hammer to fall upon said receptacles, thus closing said circuit; and h) said circuit existing as an open circuit once again by pulling said handle upward, thereby shifting said balance beam to said upper position.

2. An earthquake detection device as mentioned in claim 1, wherein said parallel circuit accommodates for an additional electrical appliance.

* * * * *